US008366104B2

(12) United States Patent
Sato et al.

(10) Patent No.: US 8,366,104 B2
(45) Date of Patent: Feb. 5, 2013

(54) SHEET CONVEYING DEVICE AND RECORDING APPARATUS

(75) Inventors: Ryosuke Sato, Kawasaki (JP); Kenji Shigeno, Yokohama (JP); Masato Izumi, Kawasaki (JP); Tetsuhiro Nitta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 260 days.

(21) Appl. No.: 12/964,681

(22) Filed: Dec. 9, 2010

(65) Prior Publication Data

US 2011/0210500 A1 Sep. 1, 2011

(30) Foreign Application Priority Data

Feb. 26, 2010 (JP) ..... 2010-041661

(51) Int. Cl.
*B65H 9/00* (2006.01)

(52) U.S. Cl. ..... 271/236; 271/226; 271/228; 271/250; 271/242

(58) Field of Classification Search ..... 271/226, 271/228, 229, 236, 242, 245, 248, 250, 251, 271/273
See application file for complete search history.

(56) References Cited

U.S. PATENT DOCUMENTS

| | | | | |
|---|---|---|---|---|
| 5,335,904 | A * | 8/1994 | Ryuzaki | 271/272 |
| 5,507,482 | A * | 4/1996 | Tenpaku et al. | 271/251 |
| 6,273,418 | B1 * | 8/2001 | Fujikura et al. | 271/228 |
| 7,306,221 | B2 | 12/2007 | Agata | |
| 7,445,208 | B2 * | 11/2008 | Onodera | 271/239 |
| 7,753,370 | B2 * | 7/2010 | Inoue | 271/239 |
| 8,205,879 | B2 * | 6/2012 | Fujita et al. | 271/251 |
| 2005/0242493 | A1 * | 11/2005 | Agata | 271/226 |
| 2007/0023995 | A1 * | 2/2007 | Onodera | 271/226 |
| 2007/0222144 | A1 * | 9/2007 | Inui et al. | 271/291 |
| 2008/0232879 | A1 * | 9/2008 | Shoji et al. | 399/395 |
| 2009/0091075 | A1 * | 4/2009 | Yasumoto | 271/250 |
| 2010/0327519 | A1 * | 12/2010 | Miyazawa | 271/248 |

FOREIGN PATENT DOCUMENTS

| | | |
|---|---|---|
| JP | 09-40230 A | 2/1997 |
| JP | 4035514 A | 1/2008 |

OTHER PUBLICATIONS

U.S. Appl. No. 13/084,387, filed Apr. 11, 2011, Masaki Maeno.
U.S. Appl. No. 12/965,774, filed Dec. 10, 2010, Ryosuke Sato.
U.S. Appl. No. 12/945,598, filed Jan. 12, 2010, Koichiro Kawaguchi.
U.S. Appl. No. 12/941,856, filed Nov. 18, 2010, Yosui Naito.
U.S. Appl. No. 12/834,651, filed Jul. 12, 2010, Tetsuhiro Nitta.
U.S. Appl. No. 12/825,071, filed Jun. 28, 2010, Naoki Ishikawa.
U.S. Appl. No. 12/958,245, filed Dec. 1, 2010, Hironori Naka.

* cited by examiner

*Primary Examiner* — Michael McCullough
*Assistant Examiner* — Howard Sanders
(74) *Attorney, Agent, or Firm* — Canon U.S.A., Inc. IP Division

(57) ABSTRACT

A device includes a conveying unit conveying a sheet, a guide, disposed downstream of the conveying unit in a conveying direction, guiding one side end of the conveyed sheet while being in contact with a side end, a feeding unit obliquely conveying the sheet closer to the guide, a pressing unit pressing the conveyed sheet in a direction in which the sheet moves away from the guide, and a control unit controlling the pressing unit and the feeding unit so that the feeding unit nips the pressed sheet to form a loop in the sheet between the conveying unit and the feeding unit and then conveys the sheet while the side end of the sheet is in sliding contact with the guide.

14 Claims, 11 Drawing Sheets

SHEET CONVEYING DEVICE AND RECORDING APPARATUS

BACKGROUND OF THE INVENTION

1. Field of the Invention

The present invention relates to a sheet conveying device and a recording apparatus for recording an image onto a sheet.

2. Description of the Related Art

In a related-art image forming apparatus disclosed in Japanese Patent No. 4035514, to correct a skew of a sheet, the sheet is conveyed while a pair of oblique-feed rollers allow the sheet to abut against an abutment guide that is parallel to a conveying direction. The rotating surfaces of the pair of oblique-feed rollers are oblique relative to the abutment guide. The abutment guide is positioned back from a sheet conveying reference by a predetermined distance. After the skew-corrected sheet is conveyed to conveying rollers downstream of the abutment guide, the pair of oblique-feed rollers are separated from each other and the conveying rollers on the downstream side are moved by a predetermined distance in the direction perpendicular to the conveying direction while the sheet is nipped between the downstream conveying rollers, so that the sheet is returned to the sheet conveying reference. At this time, the abutment guide is positioned back from the sheet conveying reference by the predetermined distance to provide a landing distance necessary for skew correction so that the sheet smoothly abuts against the abutment guide.

After that, image formation is performed by an image forming unit on the downstream side, so that printing is performed with little skew.

In a post-processing apparatus disclosed in Japanese Patent Laid-Open No. 09-40230, a conveyed sheet is brought into contact with a stopper in the vicinity of one side edge of the sheet. After that, the sheet is rotated by 90 degrees by an oblique-feed roller so that the sheet abuts against an abutment guide placed at a sheet conveying reference, thus correcting a skew of the sheet.

In the above-described structure, disclosed in Japanese Patent No. 4035514, in which skew correction is performed using the abutment guide positioned back from the sheet conveying reference, however, it is difficult due to the stiffness of the sheet to allow the sheet to abut against the guide while the sheet is being nipped by a pair of conveying rollers upstream of the oblique-feed rollers. In addition, since the trailing edge of the sheet is not nipped by the pair of rollers on the upstream side upon skew correction, the position of the sheet is unstable. Disadvantageously, a corner of the leading edge of the sheet may abut against the abutment guide, thus causing corner folding.

In the apparatus disclosed in Japanese Patent Laid-Open No. 09-40230, when the oblique-feed roller allows the sheet to abut against the guide, the trailing edge of the sheet has to come out of the nips of the conveying rollers upstream of the oblique-feed roller. Therefore, there is a problem in that the apparatus cannot deal with a long sheet, such as a continuous sheet.

SUMMARY OF THE INVENTION

According to an aspect of the present invention, a device includes a conveying unit configured to convey a sheet, a guide configured to guide one side end of the conveyed sheet while being in contact with a side end of the sheet, the guide being disposed downstream of the conveying unit in a conveying direction, a feeding unit configured to obliquely convey the sheet closer to the guide, a pressing unit configured to press the conveyed sheet in a direction in which the sheet moves away from the guide, and a control unit configured to control the pressing unit and the feeding unit so that the feeding unit nips the pressed sheet to form a loop in the sheet between the conveying unit and the feeding unit and then conveys the sheet while the side end of the sheet is in sliding contact with the guide.

Further features of the present invention will become apparent from the following description of exemplary embodiments with reference to the attached drawings.

DESCRIPTION OF THE EMBODIMENTS

First Embodiment

An inkjet recording apparatus according to a first embodiment will be described below. The recording apparatus according to the present embodiment uses a rolled continuous sheet. The apparatus is a high speed line printer that supports both of single-side printing and duplex printing. For example, this apparatus is suitable for printing of a large number of sheets in, for example, a print laboratory. The present invention is widely applicable to printing apparatuses, such as a printer, a multifunction printer, a copying machine, a facsimile machine, and manufacturing apparatuses for various devices. The present invention is also applicable to a sheet processing device that performs not only printing but also various processes (recording, processing, applying, irradiation, scanning, and inspection) on a rolled sheet.

Figure 1:
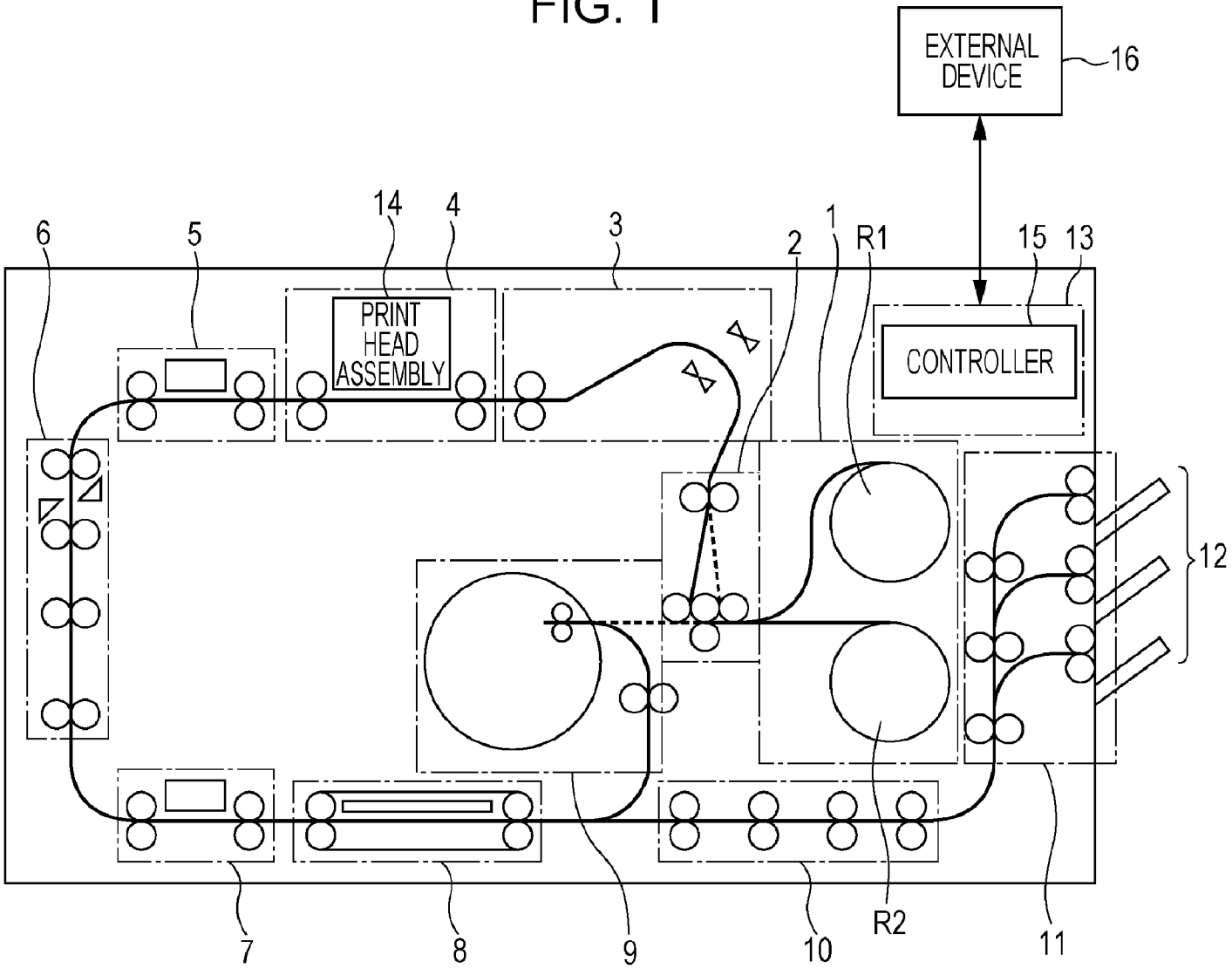
FIG. 1 is a schematic view of the internal structure of a recording apparatus.

FIG. 1 is a schematic cross-sectional view of the internal structure of the recording apparatus. The recording apparatus according to the present embodiment can print on both of a first side of a rolled sheet and a second side opposite the first side. The recording apparatus broadly includes a sheet feeding unit 1, a decurling unit 2, a skew correcting unit 3, a printing unit 4, an inspecting unit 5, a cutter unit 6, an information recording unit 7, a drying unit 8, a sheet take-up unit 9, a discharge conveying unit 10, a sorter unit 11, a discharging unit 12, and a control unit 13. A sheet is conveyed along a sheet conveying path indicated by solid lines in FIG. 1 by a conveying mechanism including pairs of rollers and belts and is subjected to processes by the above-described units. In an arbitrary position in the sheet conveying path, the side adjacent to the sheet feeding unit 1 will be called "upstream" and the opposite side will be called "downstream".

The sheet feeding unit 1 is configured to receive a rolled continuous sheet and feeds the sheet. The sheet feeding unit 1 can hold two rolls R1 and R2 and is configured to selectively feed the sheet. The number of rolls which can be received is not limited to two. One or three or more rolls may be received.

The decurling unit 2 is configured to reduce curling (warping) of the sheet fed from the sheet feeding unit 1. In the decurling unit 2, two pinch rollers are used relative to one driving roller to curve the sheet so that warping in a direction opposite to the curl is applied to the sheet and the sheet is allowed to pass through the nips. Consequently, a decurling force is applied to the curled sheet, thus reducing the curl.

The skew correcting unit 3 is configured to correct a skew (inclination relative to the original traveling direction) of the sheet passed through the decurling unit 2. One side, serving as a reference side, of the sheet is urged against a guide member, thus correcting the skew of the sheet.

The printing unit 4 is configured to form an image on the conveyed sheet through a print head assembly 14 which includes plurality of print heads, serving as a recording unit. The printing unit 4 further includes a plurality of conveying rollers for conveying the sheet. The print head assembly 14 includes a line print head assembly including an inkjet nozzle array in a range that covers a maximum width of a sheet which will be used. The print head assembly 14 includes a plurality of print heads arranged in parallel to each other in the conveying direction. In this embodiment, the print head assembly 14 includes seven print heads corresponding to seven colors, i.e., cyan (C), magenta (M), yellow (Y), light cyan (LC), light magenta (LM), gray (G), and black (K). The number of colors and the number of print heads are not limited to seven. As for the inkjet type, a type using a heating element, a type using a piezoelectric element, a type using an electrostatic element, or a type using a micro-electro-mechanical system (MEMS) element may be used. Each color ink is supplied from an ink tank through an ink tube to the print head assembly 14.

The inspecting unit 5 includes a scanner that optically scans a test pattern or image printed on the sheet through the printing unit 4 and is configured to inspect, for example, the states of nozzles of the print heads, a sheet conveying state, and the position of the image to determine whether the image is correctly printed. The scanner includes a CCD image sensor or a CMOS image sensor.

The cutter unit 6 includes mechanical cutters to cut the printed sheet having a predetermined length. The cutter unit 6 further includes a plurality of conveying rollers for conveying the sheet to the subsequent unit for the next processing.

The information recording unit 7 is configured to record print information (information peculiar to each image), such as a print serial number and the date, on the rear surface of the cut sheet. The drying unit 8 heats the sheet printed through the printing unit 4 to dry the applied ink for a short time. In the drying unit 8, hot air is applied to at least the lower surface of the sheet passing the drying unit 8 to dry the ink-applied surface of the sheet. The drying method is not limited to hot air application. The sheet surface may be irradiated with electromagnetic waves (ultraviolet rays or infrared rays). The drying unit 8 includes a conveying belt and conveying rollers for conveying the sheet to the subsequent unit for the next processing.

The sheet conveying path from the sheet feeding unit 1 to the drying unit 8 will be called a first path. A portion of the first path between the printing unit 4 and the drying unit 8 is U-shaped. The cutter unit 6 is positioned in the middle of the U-shaped portion.

The sheet take-up unit 9 is configured to temporarily take up the continuous sheet whose front surface has been subjected to printing for duplex printing to invert the sheet. The sheet take-up unit 9 is placed in the middle of a path (loop path) which will be called a second path and extends from the drying unit 8 through the decurling unit 2 to the printing unit 4 and is used to refeed the sheet passed the drying unit 8 to the printing unit 4. The sheet take-up unit 9 includes a take-up drum which rotates to take up the sheet. The continuous sheet whose front surface (first side) has been subjected to printing and which is not cut is temporarily taken up by the take-up drum. After the sheet is taken up, the take-up drum rotates backward to feed the taken up sheet to the decurling unit 2 in the reverse order from that in which the sheet is taken up. The sheet is then fed to the printing unit 4. Since the sheet is inverted, the rear surface (second side) of the sheet can be subjected to printing through the printing unit 4. A duplex printing operation will be described in more detail later.

The discharge conveying unit 10 is configured to convey the sheet, which has been cut through the cutter unit 6 and been dried through the drying unit 8, to the sorter unit 11. The discharge conveying unit 10 is placed in a path (referred to as a third path) different from the second path in which the sheet take-up unit 9 is provided. To selectively introduce the sheet conveyed through the first path to either of the second path and the third path, a path switching mechanism having a movable flapper is disposed in a branch point between the paths.

The sorter unit 11 and the discharging unit 12 are arranged in the end of the third path such that the units are adjacent to one side of the sheet feeding unit 1. The sorter unit 11 is configured to sort the sheets into groups and discharge the grouped sheets to different trays of the discharging unit 12. The sorted sheets are discharged to the discharging unit 12 including the trays. As described above, the third path extends below the sheet feeding unit 1 to discharge a sheet to the opposite side of the sheet feeding unit 1 relative to the printing unit 4 and the drying unit 8.

The control unit 13 is configured to control the units of the entire recording apparatus. The control unit 13 includes a controller 15 including a central processing unit (CPU), memories, and various input-output (I/O) interfaces, and a power supply. An operation of the recording apparatus is controlled in accordance with an instruction supplied from the controller 15 or an external device 16, such as a host computer, connected through the I/O interface to the controller 15.

Figure 2:
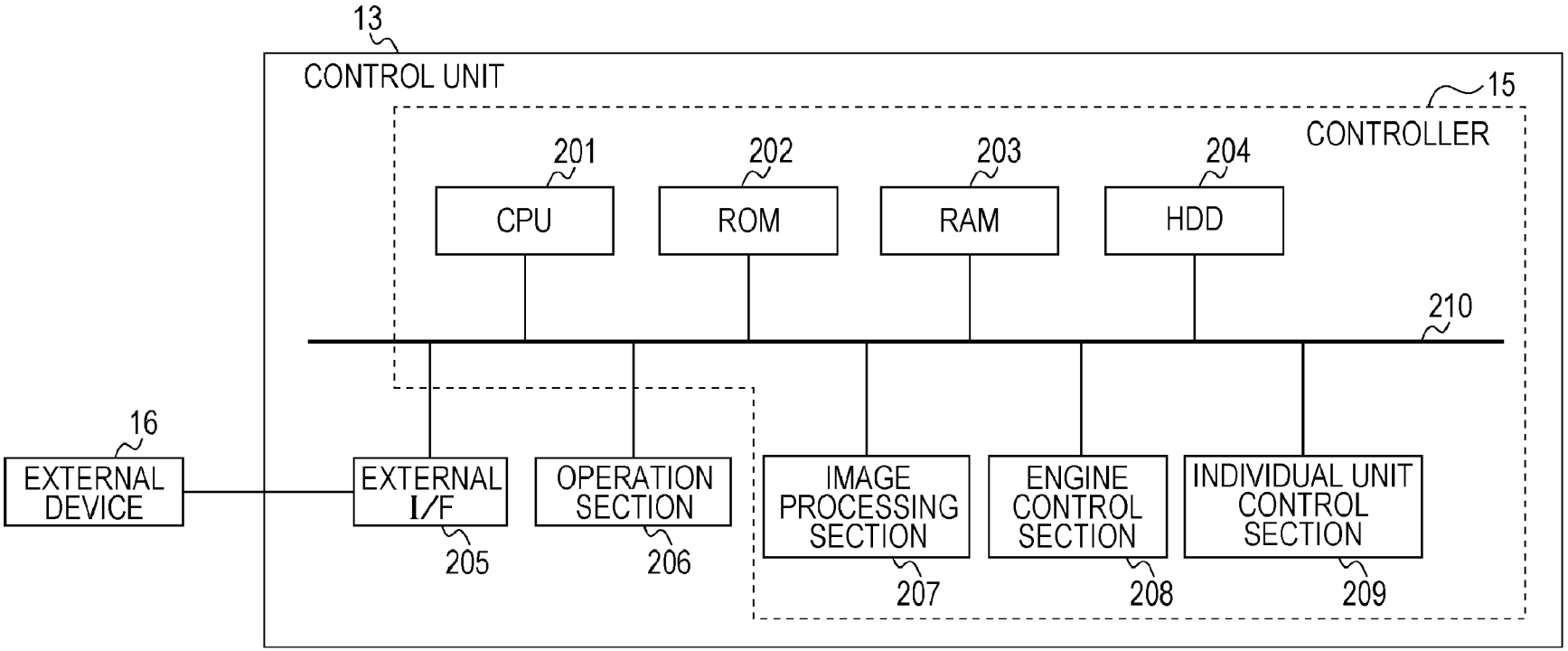
FIG. 2 is a block diagram illustrating the concept of a control unit.

FIG. 2 is a block diagram illustrating the concept of the control unit 13. The controller 15, surrounded by a dashed line, included in the control unit 13 includes the CPU, indicated at 201, a read-only memory (ROM) 202, a random access memory (RAM) 203, a hard disk drive (HDD) 204, an image processing section 207, an engine control section 208, and an individual unit control section 209. The CPU 201 integrally controls operations of the individual units of the recording apparatus. The ROM 202 stores a program to be executed by the CPU 201 and fixed data necessary for various operations of the recording apparatus. The RAM 203 is used as a work area of the CPU 201 and a temporal storage area for various received data items, and also stores various set data items. The HDD 204 stores a program to be executed by the CPU 201, print data, and setting information necessary for various operations of the recording apparatus such that data can be read out from the HDD 204. An operation section 206 serves as a user I/O interface and includes an input portion, such as a hard key and a touch panel, and an output portion, such as a display for providing information and an audio generator.

As for the units required to perform high-speed data processing, a dedicated processing section is provided for each of these units. The image processing section 207 performs image processing for print data handled by the recording apparatus. For example, the image processing section 207 converts a color space (e.g., YCbCr color space) of input image data to a standard RGB color space (e.g., sRGB color space). Various image processes, such as resolution conversion, image analysis, and image correction, are performed on image data as necessary. The resultant print data subjected to these image processes is stored into the RAM 203 or the HDD 204. The engine control section 208 drives the print head assembly 14 of the printing unit 4 in accordance with print data on the basis of a control command supplied from, for example, the CPU 201. The engine control section 208 also controls conveying mechanisms of the individual units in the recording apparatus. The individual unit control section 209 is a sub-controller for individually controlling the units, i.e., the sheet feeding unit 1, the decurling unit 2, the skew correcting unit 3, the inspecting unit 5, the cutter unit 6, the information recording unit 7, the drying unit 8, the sheet take-up unit 9, the discharge conveying unit 10, the sorter unit 11, and the discharging unit 12. Operations of the units are controlled by the individual unit control section 209 on the basis of instructions from the CPU 201. An external interface (I/F) 205 is used to connect the controller 15 to the external device 16 and includes a local I/F or a network I/F. The above-described components are connected by a system bus 210.

The external device 16 serves as a source to supply image data for allowing the recording apparatus to print. The external device 16 may be a general-purpose or dedicated computer, or may be a dedicated image device, such as an image capture, a digital camera, or a photo storage, including an image reader unit. When the external device 16 is a computer, an operating system (OS), application software for generation of image data, and a printer driver for the recording apparatus are installed in a memory unit included in the computer. It is not necessary to realize all of the above-described processes by software. Part or all of the processes may be realized by hardware.

A basic operation upon printing will now be described. Since an operation upon single-side printing differs from that upon duplex printing, these operations will be described below.

Figure 3:
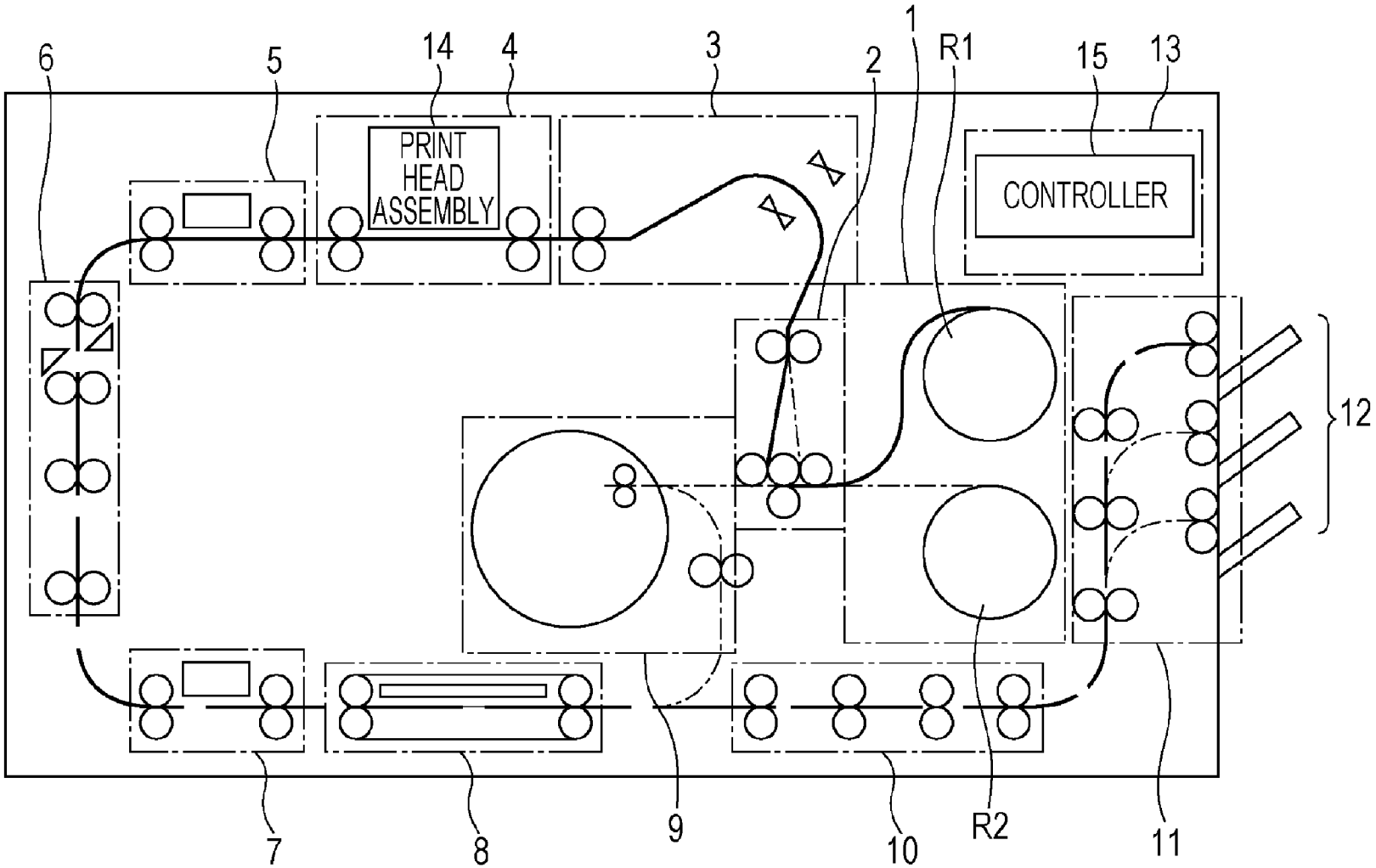
FIG. 3 is a diagram explaining an operation upon single-side printing.

FIG. 3 is a diagram explaining the operation upon single-side printing. Thick lines indicate a conveying path in which a sheet fed from the sheet feeding unit 1 travels to the discharging unit 12 from which the sheet is discharged after being subjected to printing. The sheet fed from the sheet feeding unit 1 is processed by the decurling unit 2 and the skew correcting unit 3. After that, the front surface (first side) of the sheet is subjected to printing through the printing unit 4. On the long continuous sheet, images (unit images) each having a predetermined unit length in the conveying direction are sequentially printed such that a plurality of formed images are arranged. The printed sheet passes through the inspecting unit 5 and is then cut into sheet segments each having a unit image by the cutter unit 6. As for each cut sheet segment, print information is printed onto the rear surface of the sheet segment by the information recording unit 7 as necessary. The cut sheet segments are conveyed one by one to the drying unit 8 and each sheet segment is dried. After that, the sheet segments are conveyed through the discharge conveying unit 10 and the sorter unit 11 to the discharging unit 12 and are then sequentially discharged and stacked onto any of the trays. On the other hand, the sheet left adjacent to the printing unit 4 upon cutting a sheet segment having the last unit image is fed backward to the sheet feeding unit 1 and is taken up onto the roll R1 or R2.

In the single-side printing, the sheet is processed while traveling in the first and third paths and does not travel the second path. Specifically, the following sequence steps (1) to (6) are executed under the control of the control unit 13 in such a single-side printing mode.

(1) Feeding the sheet from the sheet feeding unit 1 to the printing unit 4;

(2) Repeating unit-image printing on the first side of the fed sheet in the printing unit 4;

(3) Repeating cutting of the sheet into sheet segments each having the printed unit image on the first side in the cutter unit 6;

(4) Allowing the cut sheet segments each having the unit image to pass through the drying unit 8 one by one;

(5) Discharging the sheet segments passed one by one through the drying unit 8 to the discharging unit 12 via the third path; and (6) Feeding the sheet left adjacent to the printing unit 4 upon cutting the sheet segment having the last unit image backward to the sheet feeding unit 1.

Figure 4:
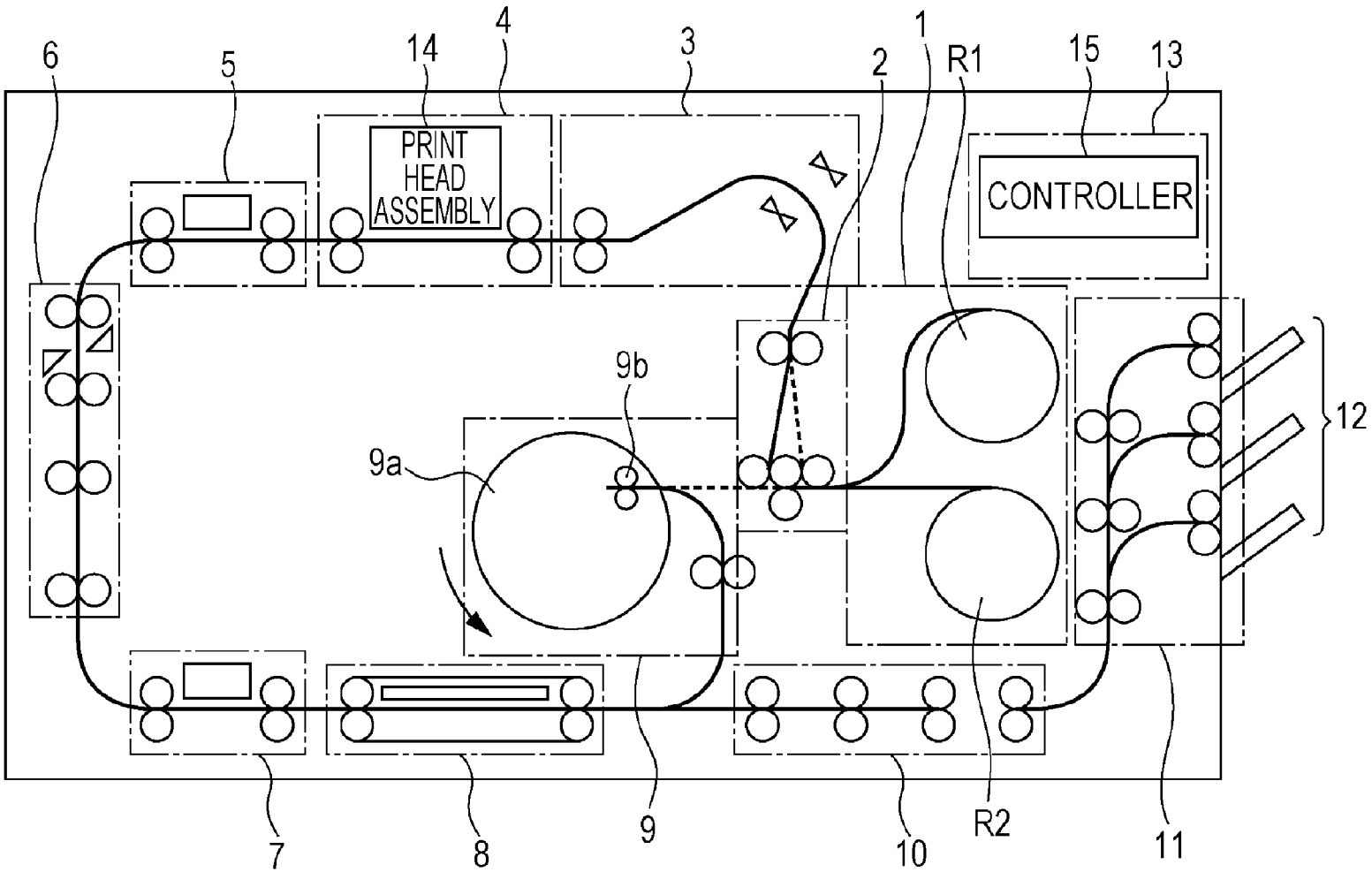
FIG. 4 is a diagram explaining an operation upon duplex printing.

FIG. 4 is a diagram explaining the operation upon duplex printing. In the duplex printing, a front-surface printing sequence is first performed and a rear-surface printing sequence is subsequently performed. In the first front-surface printing sequence, the operations of the sheet feeding unit 1 to the inspecting unit 5 are the same as those upon single-side printing described above. In the cutter unit 6, the cutting operation is not performed. The continuous sheet is conveyed as it is to the drying unit 8. The front surface of the sheet applied with ink is dried in the drying unit 8. After that, the sheet is introduced not into the path (third path) to the discharge conveying unit 10 but into the path (second path) to the sheet take-up unit 9. The leading edge of the sheet introduced in the second path is nipped by a pair of rollers 9*b* provided for the take-up drum, indicated at 9*a*, of the sheet take-up unit 9. While the leading edge of the sheet is nipped between the pair of rollers 9*b*, the take-up drum 9*a* rotates forward (counter-clockwise in FIG. 4), so that the sheet is taken up onto the take-up drum 9*a*. When the intended printing on the front surface is completed in the printing unit 4, the continuous sheet is cut at the trailing edge of a printed area on the sheet in the cutter unit 6. The continuous sheet (subjected to printing) downstream of the cut position in the conveying direction is allowed to pass through the drying unit 8 and the entire sheet to the trailing edge (cut position) is then taken up by the sheet take-up unit 9. On the other hand, the continuous sheet upstream of the cut position in the conveying direction is fed backward to the sheet feeding unit 1 so that the leading edge (cut position) of the sheet does not remain in the decurling unit 2 and is taken up onto the roll R1 or R2. This backward feeding prevents a collision between the left sheet and the sheet to be again fed in the following rear-surface printing sequence.

At the completion of the above-described front-surface printing sequence, the sequence is switched to the rear-surface printing sequence. The take-up drum 9*a* of the sheet take-up unit 9 rotates backward (clockwise in FIG. 4), i.e., in the direction opposite to that upon taking up the sheet. The end of the taken-up sheet (the trailing edge of the sheet upon taking up becomes the leading edge thereof upon feeding) is fed to the decurling unit 2 along a path indicated by a dashed line in FIG. 4. The decurling unit 2 corrects the curl of the sheet caused by the take-up drum 9*a*. Specifically, the decurling unit 2 is disposed between the sheet feeding unit 1 and the printing unit 4 in the first path and is also placed between the sheet take-up unit 9 and the printing unit 4 in the second path. The decurling unit 2 performs decurling in each of the paths and is shared by both the paths. In the decurling unit 2, curl correction in the direction opposite to that in the above-described one is performed. Simultaneously, the sheet is inverted in the conveying path in the decurling unit 2. After that, the continuous sheet passes through the skew correcting unit 3 and the rear surface of the sheet is then subjected to printing in the printing unit 4. The printed sheet passes through the inspecting unit 5 and is then cut into sheet segments each having a unit image in the cutter unit 6. The sheet is cut into sheet segments (printed products) each having the unit images on both of the front and rear surfaces. Since both the surfaces of each cut sheet segment are printed, the cut sheet segment is not subjected to recording through the information recording unit 7. The cut sheet segments are conveyed one by one to the drying unit 8. The sheet segments are conveyed through the discharge conveying unit 10 and the sorter unit 11 to the discharging unit 12 and are then sequentially discharged and stacked onto any of the trays.

As described above, in the duplex printing, the sheet is processed while passing the first path, the second path, the first path, and the third path in that order. Specifically, the following sequence steps (1) to (11) are executed under the control of the control unit 13 in such a duplex printing mode.

(1) Feeding the sheet from the sheet feeding unit 1 to the printing unit 4;

(2) Repeating unit-image printing on the first side of the fed sheet in the printing unit 4;

(3) Allowing the sheet whose first side has been printed to pass through the drying unit 8;

(4) Introducing the sheet passed through the drying unit 8 into the second path to take up the sheet onto the take-up drum 9*a* provided for the sheet take-up unit 9;

(5) Cutting the sheet at the back of the last printed unit image in the cutter unit 6 at the completion of repetitive printing on the first side;

(6) Taking up the cut sheet onto the take-up drum 9*a* until the trailing edge of the sheet reaches the take-up drum 9*a* after passing through the drying unit 8, and feeding the sheet left adjacent to the printing unit 4 upon cutting backward to the sheet feeding unit 1;

(7) Rotating the take-up drum 9*a* backward at the completion of taking up the cut sheet, and refeeding the sheet to the printing unit 4 via the second path;

(8) Repeating unit-image printing on the second side of the sheet fed via the second path in the printing unit 4;

(9) Repeating cutting of the sheet into sheet segments each having the unit image on the second side in the cutter unit 6;

(10) Allowing the cut sheet segments each having the unit image to pass one by one through the drying unit 8; and

(11) Discharging the sheet segments passed one by one through the drying unit 8 to the discharging unit 12 via the third path.

The skew correcting unit 3 in the recording apparatus with the above-described structure will be described in more detail below.

Figure 5:
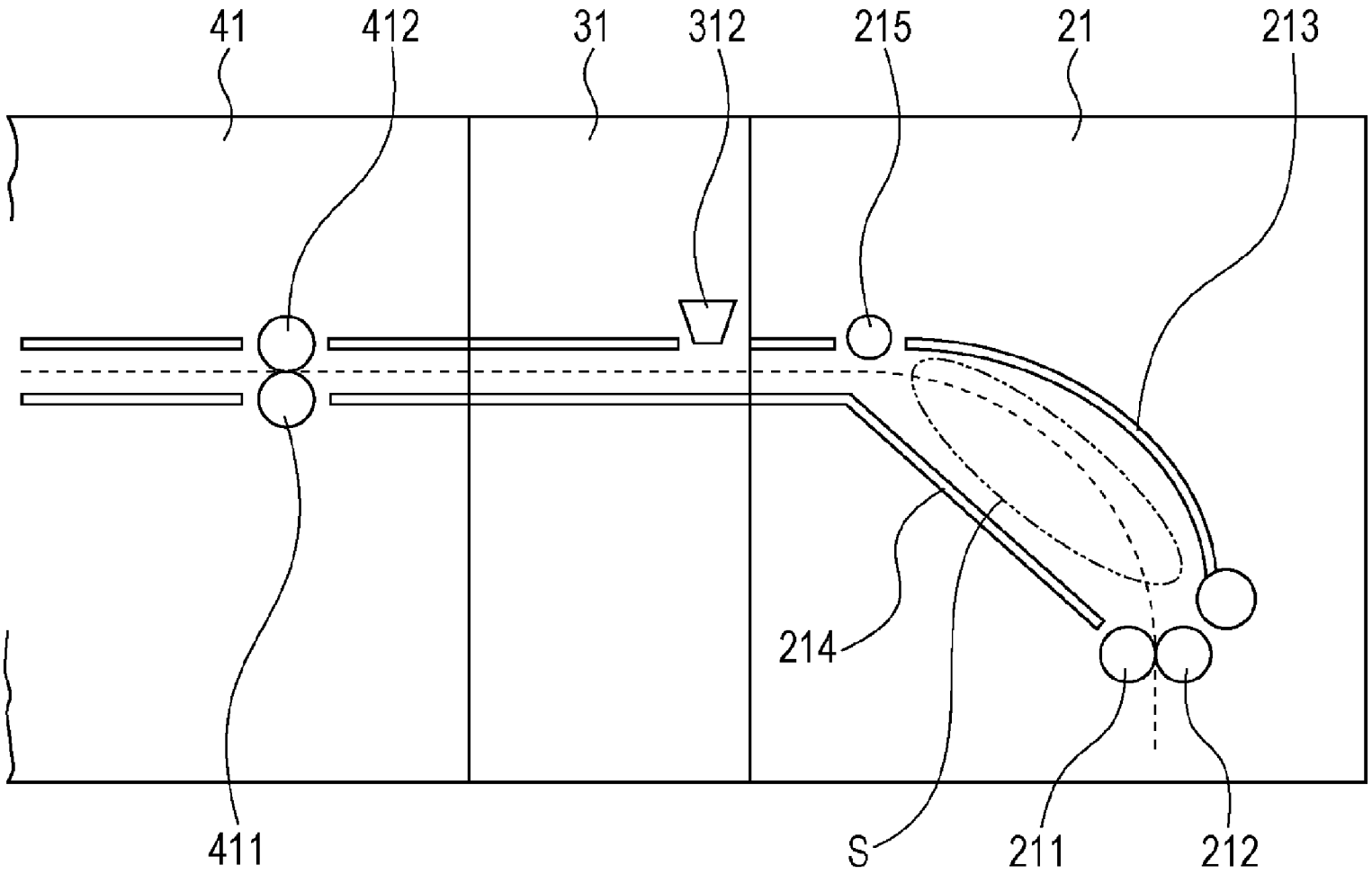
FIG. 5 is a cross-sectional view of a skew correcting unit.
Figure 6:
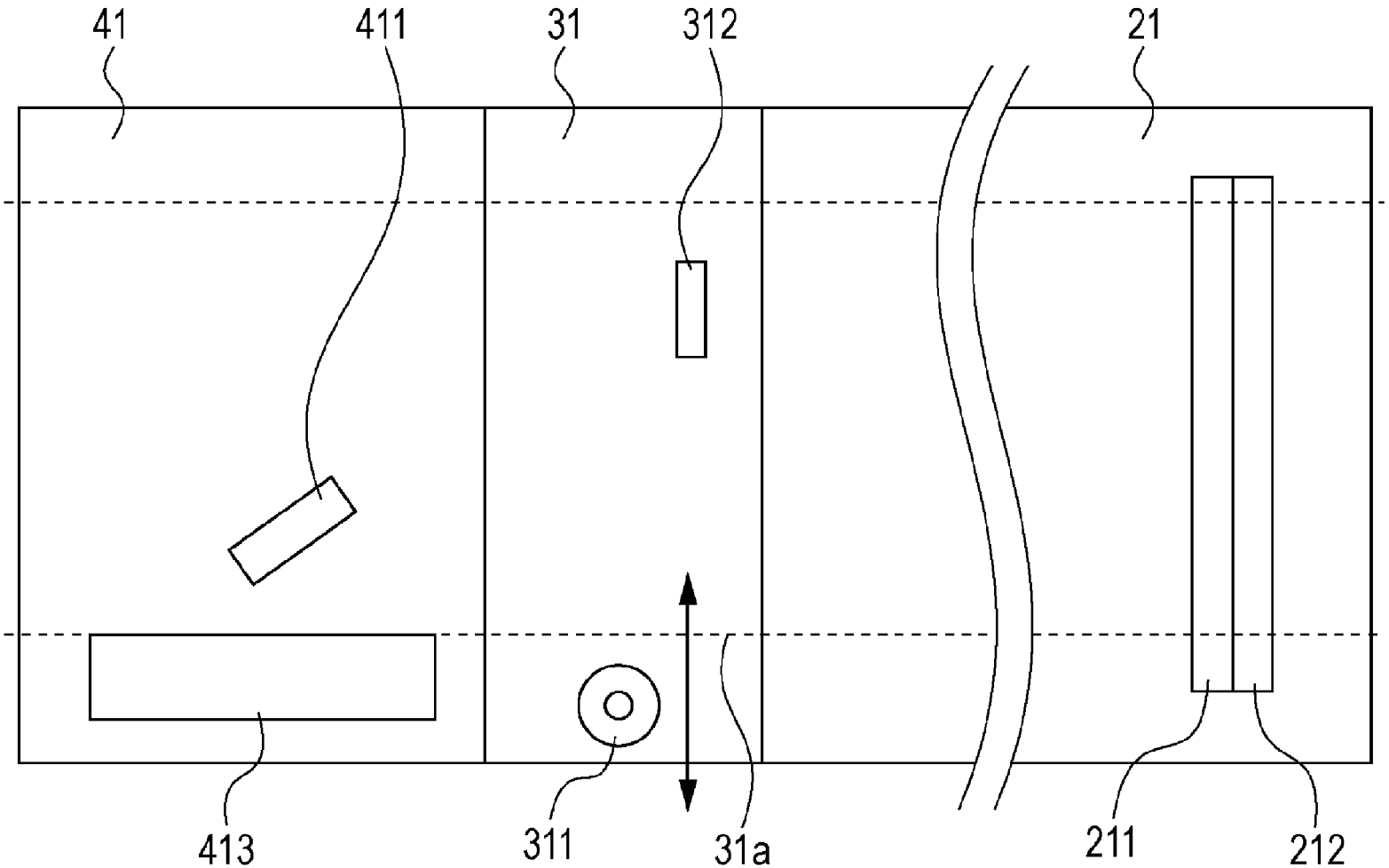
FIG. 6 is a top view of the skew correcting unit.
Figure 7:
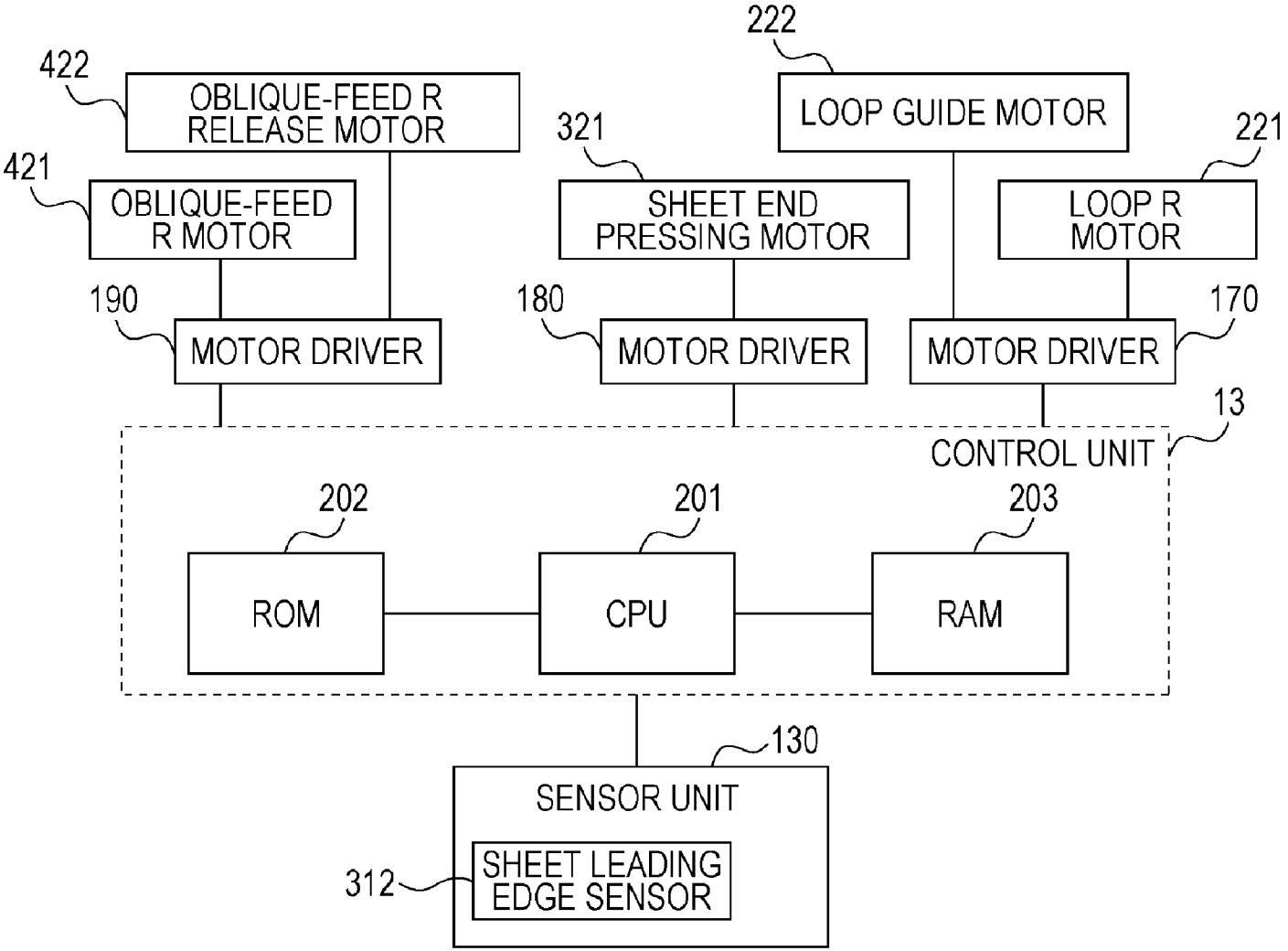
FIG. 7 is a diagram explaining a controller for the skew correcting unit.

FIGS. 5 and 6 are diagrams explaining the skew correcting unit 3 according to the first embodiment. FIG. 7 is a control block diagram for the skew correcting unit 3. The skew correcting unit 3 includes a loop unit 21, an end pressing unit 31, an oblique feeding unit 41 arranged in that order from the upstream side. The loop unit 21 provides a curved sheet path angled at substantially 90 degrees and includes a loop driving roller 211, a loop driven roller 212, an openable upper guide 213, a lower guide 214, and a driven roller 215. The loop driving roller 211, serving as a conveying unit, is drivingly connected to a loop R motor 221 (see FIG. 7) so that the loop driving roller 211 is rotated in association with the rotation of the motor. The upper guide 213 and the lower guide 214 constitute a part of the conveying path for guiding a sheet from the loop driving roller 211 to the oblique feeding unit 41.

The upper guide 213 is drivingly connected to a loop guide motor 222 so that the upper guide 213 is opened or closed in association with the rotation of the motor. A space S for allowing the sheet to bow is provided between the upper guide 213 and the lower guide 214. The end pressing unit 31 includes a cylindrical sheet end pressing guide 311 using a rotary member, and a sheet leading edge sensor 312. Dashed lines 31*a* indicate a sheet conveying reference indicating standard positions of the side ends of the sheet when the sheet travels. Driving a sheet end pressing motor 321 can move the sheet end pressing guide 311 in the direction perpendicular to the conveying direction. Driving the sheet end pressing motor 321 can move the sheet end pressing guide 311, serving as a pressing unit, to either of a first position within a sheet travel area inside the sheet conveying reference 31*a* and a second position outside the sheet conveying reference 31*a*.

The oblique feeding unit 41 includes an oblique-feed driving roller 411 and an oblique-feed driven roller 412 which are obliquely arranged relative to the conveying direction, and an abutment guide 413 disposed along the sheet conveying reference in the conveying direction. The oblique-feed driving roller 411 is driven and rotated by an oblique-feed R motor 421. The oblique-feed driving roller 411 is movable between a first position where the roller 411 is pressed against the oblique-feed driven roller 412 and a second position where the roller 411 is away from the oblique-feed driven roller 412 by an oblique-feed R release motor 422, serving as a contacting and separating (hereinafter, contacting/separating) unit.

The oblique-feed driving roller 411, serving as a feeding unit, obliquely conveys a sheet so that the sheet is closer to the abutment guide 413. The abutment guide 413 is come into contact with one side end of the sheet obliquely conveyed by the oblique-feed driving roller 411 to guide the side end of the sheet, thus correcting a skew of the sheet.

Referring to FIG. 7, the control unit 13, serving as a control unit, is a main control unit of the above-described recording apparatus. The control unit 13 includes the CPU 201, the ROM 202 storing a program and a necessary table, and other fixed data, and the RAM 203 including, for example, an area to develop image data and a work area.

A sensor unit 130 includes a group of sensors for detecting a state of the apparatus. In the present embodiment, the sensor unit 130 includes a temperature sensor (not illustrated) disposed to detect an ambient temperature and various sensors in addition to the above-described sheet leading edge sensor 312.

A motor driver 170 is configured to drive the loop R motor 221 and the loop guide motor 222. The motor driver 170 drives the loop R motor 221 to drive the driving roller 211, thus conveying the continuous sheet downstream from the loop unit 21. The motor driver 170 drives the loop guide motor 222 to open or close the upper guide 213.

A motor driver 180 is configured to drive the sheet end pressing motor 321. The motor driver 180 drives the sheet end pressing motor 321 to move the sheet end pressing guide 311 in the direction perpendicular to the conveying direction. A motor driver 190 is configured to drive the oblique-feed R motor 421 and the oblique-feed R release motor 422. The motor driver 190 drives the oblique-feed R motor 421 to drive the oblique-feed driving roller 411 so that one side end of the continuous sheet abuts against the abutment guide 413, thus correcting a skew of the sheet. The motor driver 190 drives the oblique-feed R release motor 422 to provide pressure through the nip between the oblique-feed driving roller 411 and the oblique-feed driven roller 412 or release the nip therebetween.

FIGS. 8A to 9D are diagrams explaining an operation based on a skew correction process. FIG. 10 is a flowchart of the skew correction process.

Figure 8A:
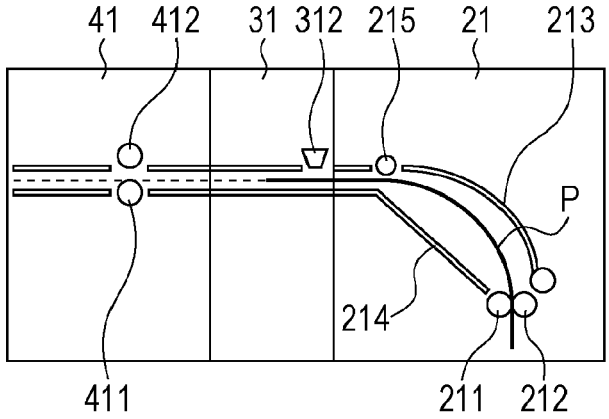
FIGS. 8A to 8D are cross-sectional views of the skew correcting unit and illustrate operations for skew correction.
Figure 9A:
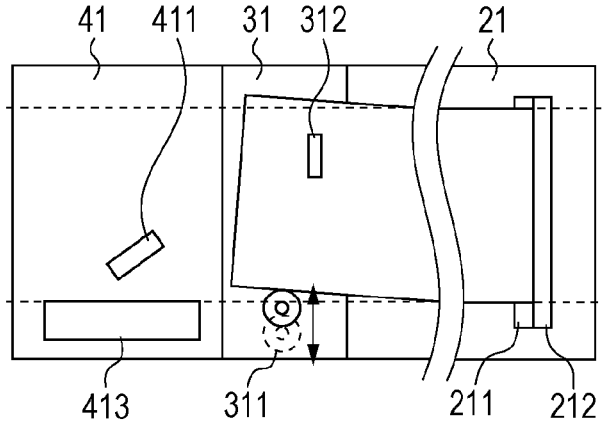
FIGS. 9A to 9D are top views of the skew correcting unit and illustrate operations for skew correction.

When sheet feeding is started, the loop R motor 221 is driven in step S101, so that the driving roller 211 starts rotating. Referring to FIG. 8A, the continuous sheet, indicated by P, conveyed from the upstream side is conveyed by the loop driving roller 211 and the loop driven roller 212. The leading edge of the continuous sheet P passes the loop unit 21 in which the upper guide 213 is closed. At this time, the oblique-feed driving roller 411 is positioned away from the oblique-feed driven roller 412.

When the leading edge of the sheet is detected by the sheet leading edge sensor 312 disposed in the end pressing unit 31 in step S102, the process proceeds to step S103 where the sheet end pressing motor 321 is driven. Referring to FIG. 9A, when the sheet end pressing motor 321 is driven, the sheet end pressing guide 311 positioned outside the sheet conveying reference 31*a* is moved forward into the sheet conveying reference 31*a*, so that the sheet end pressing guide 311 presses one side end of the continuous sheet P. Since the side end of the continuous sheet P is pressed by the sheet end pressing guide 311, the traveling direction of the conveyed continuous sheet P is shifted to a direction in which the sheet moves away from the abutment guide 413. At this time, the continuous sheet P bows in the space S between the upper guide 213 and the lower guide 214, thus causing a large resistance. Consequently, the traveling direction of the leading edge of the conveyed continuous sheet P is shifted.

Figure 8B:
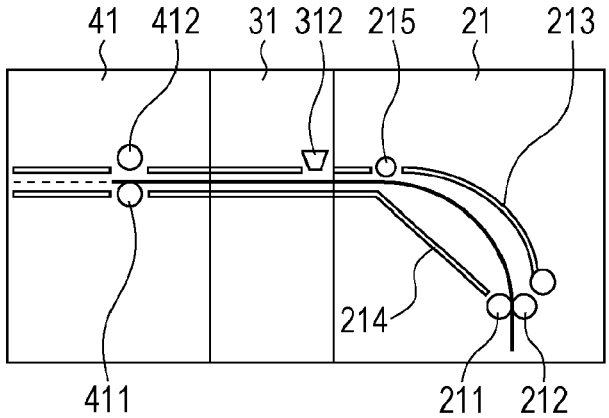
Figure 8C:
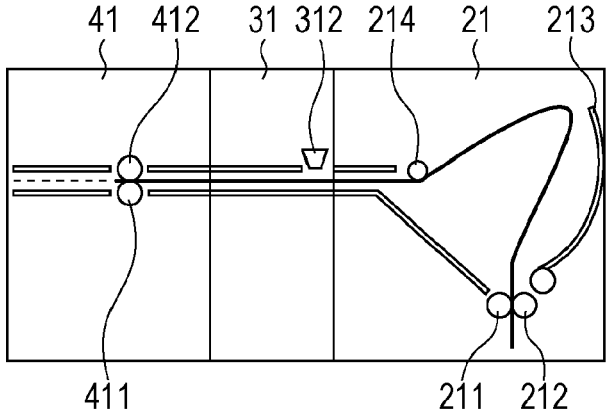
Figure 9B:
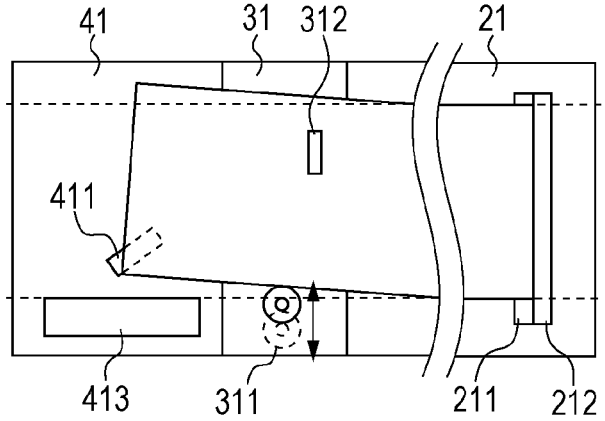
Figure 9C:
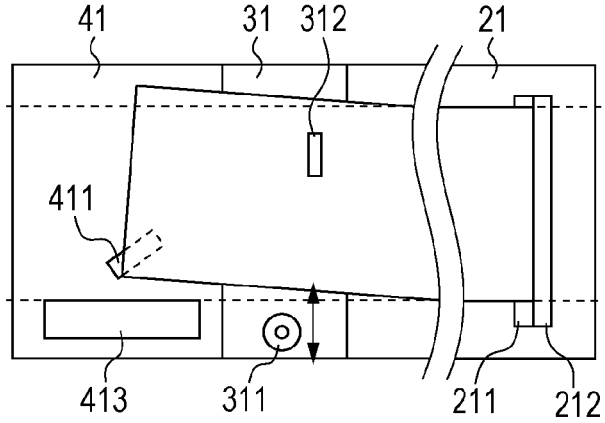
Figure 10:
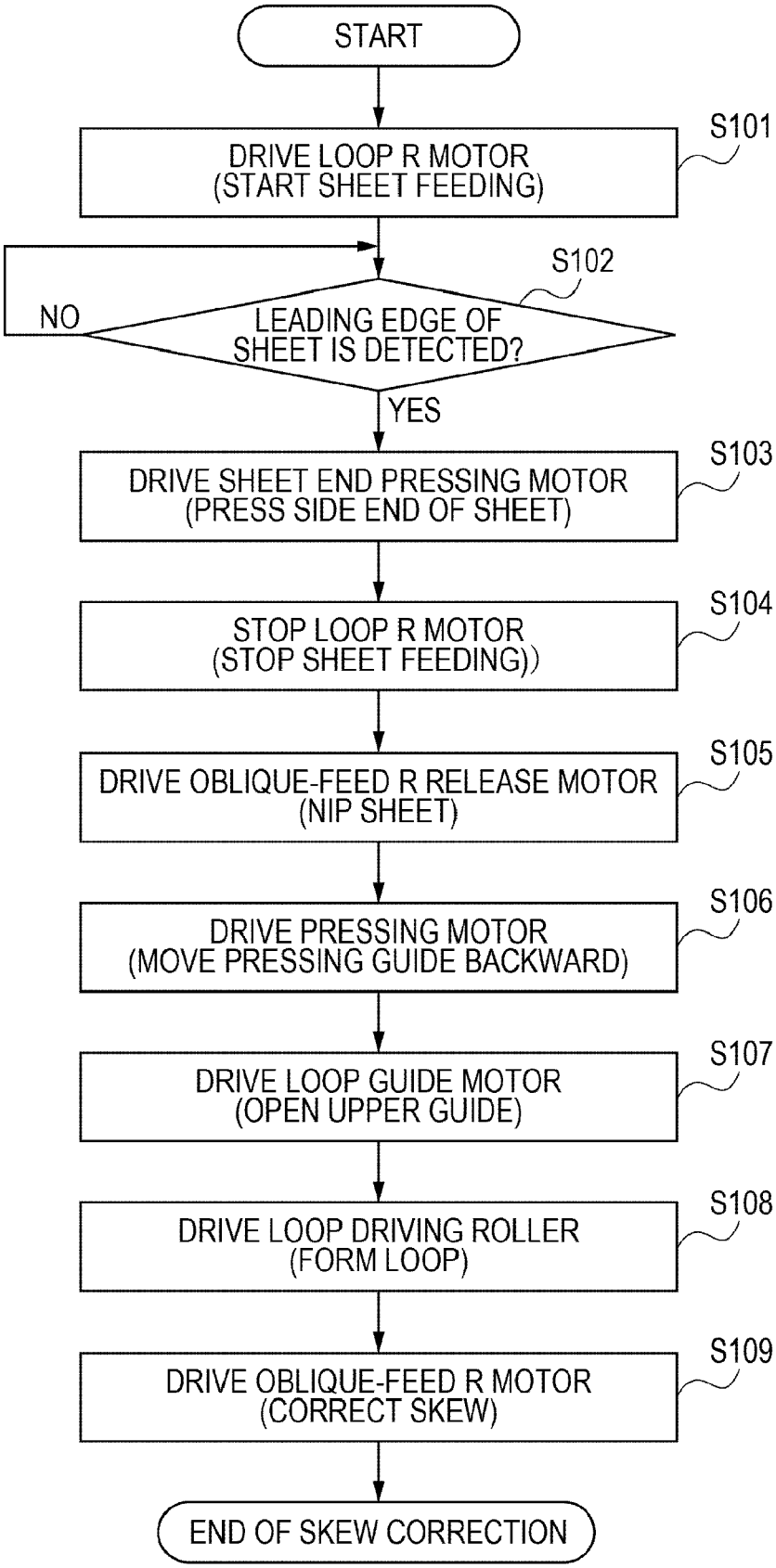
FIG. 10 is a flowchart of a skew correction process.

The leading edge of the continuous sheet P shifted by the sheet end pressing guide 311 is conveyed to the oblique feeding unit 41, as illustrated in FIGS. 8B and 9B. When the leading edge of the continuous sheet P reaches the position between the oblique-feed driving roller 411 and the oblique-feed driven roller 412 spaced apart from each other, the loop R motor 221 is stopped in step S104. The continuous sheet P is temporarily stopped. Simultaneously with stopping the loop driving roller 211, driving of all of rollers associated with the sheet conveyance on the upstream side is stopped. After that, when the oblique-feed R release motor 422 is driven in step S105, the oblique-feed driving roller 411 is pressed against the oblique-feed driven roller 412, thus nipping the continuous sheet P. Subsequently, the sheet end pressing motor 321 is driven to move the sheet end pressing guide 311 backward out of the sheet conveying reference 31*a* in step S106. After that, the loop guide motor 222 is driven in step S107, thus opening the upper guide 213 as illustrated in FIG. 8C. In step S108, the loop driving roller 211 and all of the conveying rollers upstream of the roller 211 are simultaneously driven, thus forming a loop in the continuous sheet P.

Figure 8D:
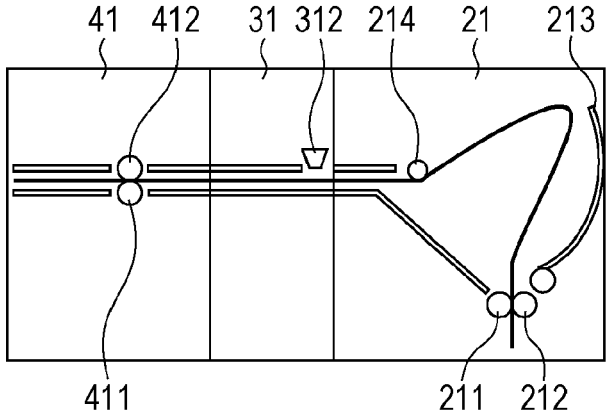
Figure 9D:
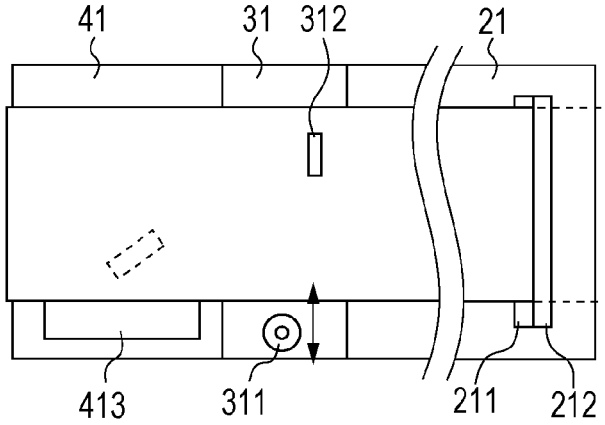

When the loop enough to correct a skew of the continuous sheet P is formed, the oblique-feed driving roller 411 is driven in step S109 at such a speed that the loop has a predetermined amount as illustrated in FIGS. 8D and 9D.

Since the conveying direction provided by the oblique-feed driving roller 411 is oblique so that the continuous sheet P is pressed against the abutment guide 413, the side end of the continuous sheet P is pressed against the abutment guide 413 while the continuous sheet P is being conveyed in the normal conveying direction. The continuous sheet P is conveyed while the side end thereof is in sliding contact with the abutment guide 413, thus correcting the skew of the sheet.

At this time, smooth abutment against the abutment guide 413 is provided so as to prevent folding of the corner of the continuous sheet P caused because the leading edge of the continuous sheet P is obliquely fed from a position away from the abutment guide 413.

Second Embodiment

Figure 11A:
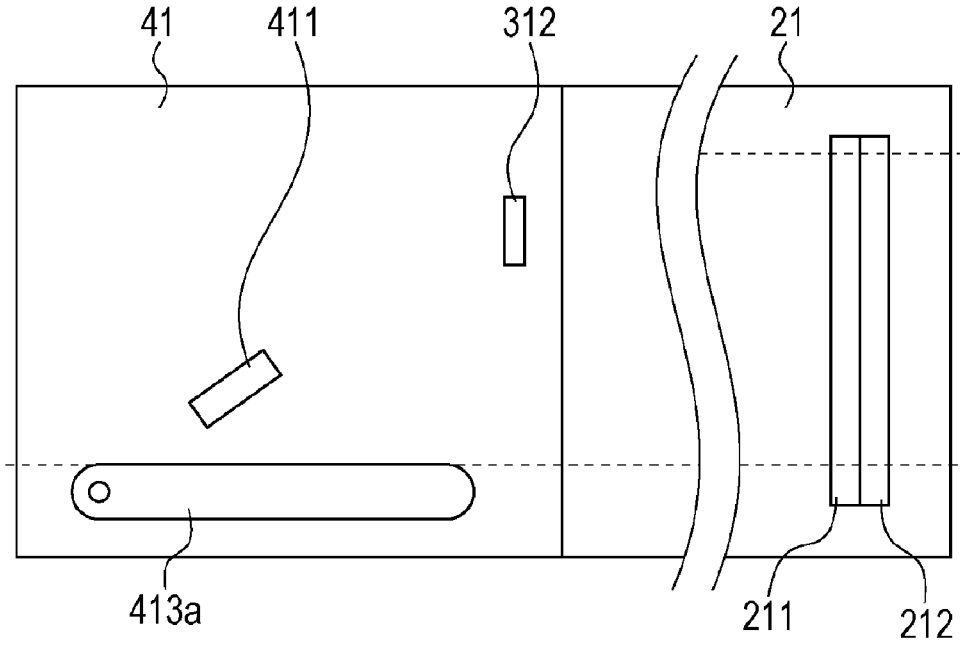
FIGS. 11A and 11B are top views of a skew correcting unit according to a second embodiment and illustrate operations for skew correction.
Figure 11B:
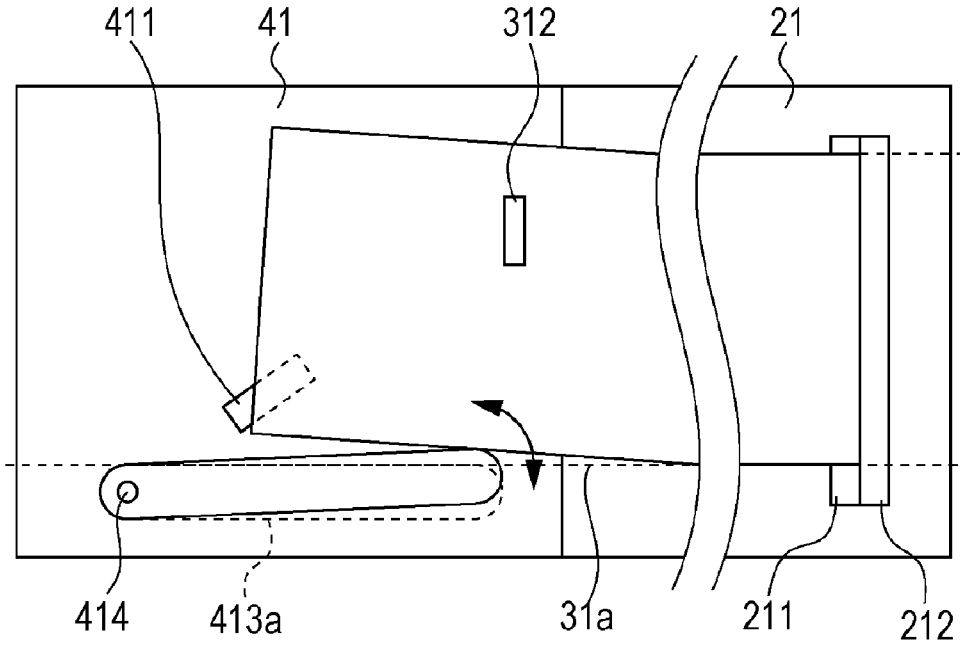

FIGS. 11A and 11B are diagrams explaining a skew correcting unit according to a second embodiment.

Referring to FIG. 11A, the skew correcting unit includes a loop unit 21 and an oblique feeding unit 41 arranged in that order from the upstream side. Since the configuration of the loop unit 21 is the same as that of the loop unit 21 in the first embodiment, the explanation thereof is omitted. The oblique feeding unit 41 includes a sheet leading edge sensor 312, an oblique-feed driving roller 411, an oblique-feed driven roller 412, and an abutment guide 413*a*. The abutment guide 413*a* is drivingly connected to a sheet end pressing motor (not illustrated). The abutment guide 413*a* has such a mechanism that the guide pivots about a rotation pin 414 in association with the rotation of the motor.

A continuous sheet P conveyed to the oblique feeding unit 41 by a loop driving roller 211 is detected by a sheet leading edge sensor 312. When the sheet leading edge sensor 312 detects the continuous sheet P, the abutment guide 413*a* is pivotally moved into a sheet conveying reference 31*a* by the sheet end pressing motor, thus pressing one side end of the continuous sheet P. Since the side end of the continuous sheet P is pressed by the abutment guide 413*a*, the traveling direction of the sheet is shifted to a direction in which the sheet moves away from the abutment guide 413*a*.

After that, the continuous sheet P shifted by the pivotal movement of the abutment guide 413*a* is nipped between the oblique-feed driving roller 411 and the oblique-feed driven roller 412 and the abutment guide 413*a* is returned to the reference position. After the continuous sheet P is nipped between the oblique-feed driving roller 411 and the oblique-feed driven roller 412, a loop is formed in a manner similar to the first embodiment. The continuous sheet P is conveyed along the abutment guide 413*a* by the oblique-feed driving roller 411 and the oblique-feed driven roller 412, thus correcting a skew of the sheet. In the present embodiment, the abutment guide 413*a* is designed to pivot about the rotation pin 414 disposed on one end of the guide on the downstream side. The pin may be disposed at the other end of the guide on the upstream side. The guide may be designed to move in the direction perpendicular to the conveying direction.

Since a control unit according to the present embodiment has the same configuration as that in the first embodiment, the illustration and explanation thereof are omitted.

In the above-described embodiments, the oblique-feed driving roller 411 is moved to space the oblique-feed driving roller 411 and the oblique-feed driven roller 412 apart from each other. The oblique-feed driven roller 412 may be moved. Alternatively, both of the oblique-feed driving roller 411 and the oblique-feed driven roller 412 may be moved.

In the above-described embodiments, even when a sheet is nipped between the pair of conveying rollers arranged upstream of the skew correcting unit, a skew of the sheet can be corrected. Accordingly, a continuous sheet, such as a rolled sheet, can also be subjected to skew correction.

Before one side end of a sheet is allowed to abut against the abutment guide, the traveling direction of the sheet is temporarily shifted using the flexibility of the sheet so that the side end of the sheet is apart from the abutment guide while the trailing edge of the sheet is being nipped (under nip pressure) between the conveying rollers. Such a series of actions moves the leading edge of the sheet to be subjected to skew correction to a position where the sheet does not abut against the abutment guide, thus reducing jam caused by, for example, corner folding which may occur when the sheet is allowed to abut against the guide.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-041661 filed Feb. 26, 2010, which is hereby incorporated by reference herein in its entirety.

What is claimed is:

1. A device comprising:

a conveying unit configured to convey a sheet;

a guide configured to guide one side end of the conveyed sheet while being in contact with a side end of the sheet, the guide being disposed downstream of the conveying unit in a conveying direction;

a feeding unit configured to obliquely convey the sheet closer to the guide;

a pressing unit configured to press the conveyed sheet in a direction in which the sheet moves away from the guide; and a control unit configured to control the pressing unit and the feeding unit so that the feeding unit nips the pressed sheet to form a loop in the sheet between the conveying unit and the feeding unit and then conveys the sheet while the side end of the sheet is in sliding contact with the guide.

2. The device according to claim 1, wherein the feeding unit includes a feeding roller and a driven roller and conveys the sheet while the sheet is nipped between the feeding roller and the driven roller.

3. The device according to claim 2, further comprising:

a contacting/separating unit configured to separate the feeding roller from the driven roller or press the feeding roller against the driven roller, wherein the control unit controls the contacting/separating unit and the conveying unit so that when the conveyed sheet reaches a position between the feeding roller and the driven roller, the contacting/separating unit allows the feeding roller and the driven roller to nip the sheet therebetween and the conveying unit conveys the sheet to form a loop in the sheet while the feeding roller is stopped.

4. The device according to claim 3, further comprising:

a guide member configured to provide a conveying path for guiding the sheet from the conveying unit to the feeding unit to allow the formation of the loop in the sheet between the conveying unit and the feeding unit; and a moving unit configured to move the guide member, wherein the control unit controls the moving unit to move the guide member upon forming the loop in the sheet.

5. The device according to claim 4, wherein the conveying path for guiding the sheet from the conveying unit to the feeding unit is curved.

6. The device according to claim 1, further comprising:

a sensor configured to detect the sheet, wherein the control unit controls the pressing unit in accordance with a result of sheet detection by the sensor.

7. The device according to claim 1, wherein the sheet is a rolled sheet and the device further includes:

a sheet feeding unit configured to hold the rolled sheet, pull the held rolled sheet, and feed the sheet to the conveying unit.

8. An apparatus comprising:

the device according to claim 1; and a recording unit configured to record an image onto a sheet conveyed by the device.

9. The apparatus according to claim 8, wherein the feeding unit includes a feeding roller and a driven roller and conveys the sheet while the sheet is nipped between the feeding roller and the driven roller.

10. The apparatus according to claim 9, wherein the device further comprises:

a contacting/separating unit configured to separate the feeding roller from the driven roller or press the feeding roller against the driven roller, wherein the control unit controls the contacting/separating unit and the conveying unit so that when the conveyed sheet reaches a position between the feeding roller and the driven roller, the contacting/separating unit allows the feeding roller and the driven roller to nip the sheet therebetween and the conveying unit conveys the sheet to form a loop in the sheet while the feeding roller is stopped.

11. The apparatus according to claim 10, wherein the device further comprises:

a guide member configured to provide a conveying path for guiding the sheet from the conveying unit to the feeding unit to allow the formation of the loop in the sheet between the conveying unit and the feeding unit; and a moving unit configured to move the guide member, wherein the control unit controls the moving unit to move the guide member upon forming the loop in the sheet.

12. The apparatus according to claim 11, wherein the conveying path for guiding the sheet from the conveying unit to the feeding unit is curved.

13. The apparatus according to claim 8, wherein the device further comprises:

a sensor configured to detect the sheet, wherein the control unit controls the pressing unit in accordance with a result of sheet detection by the sensor.

14. The apparatus according to claim 8, wherein the sheet is a rolled sheet and the device further includes:

a sheet feeding unit configured to hold the rolled sheet, pull the held rolled sheet, and feed the sheet to the conveying unit.

* * * * *